US011626674B2

(12) United States Patent
Phatiwuttipat et al.

(10) Patent No.: US 11,626,674 B2
(45) Date of Patent: Apr. 11, 2023

(54) TERMINAL AND FLEXIBLE BOARD WITH TERMINAL

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Pipatthana Phatiwuttipat, Mie (JP); Masaaki Tabata, Mie (JP); Yasuo Omori, Mie (JP)

(73) Assignees: AUTONETWORKS TECHNOLOGIES, LTD., Mie (JP); SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/612,063

(22) PCT Filed: May 12, 2020

(86) PCT No.: PCT/JP2020/018965
§ 371 (c)(1),
(2) Date: Nov. 17, 2021

(87) PCT Pub. No.: WO2020/241243
PCT Pub. Date: Dec. 3, 2020

(65) Prior Publication Data

US 2022/0209441 A1 Jun. 30, 2022

(30) Foreign Application Priority Data

May 29, 2019 (JP) ..... JP2019-100018

(51) Int. Cl.
*H01R 12/69* (2011.01)

(52) U.S. Cl.
CPC ..... *H01R 12/69* (2013.01)

(58) Field of Classification Search
CPC ..... H01R 12/592; H01R 12/675; H01R 12/69
See application file for complete search history.

(56) References Cited

U.S. PATENT DOCUMENTS 3,336,565 A * 8/1967 Crimmins ..... H01R 12/78 439/459
5,632,638 A 5/1997 Matsushita et al.
(Continued)

FOREIGN PATENT DOCUMENTS

JP H04-141969 A 5/1992
JP 2004-040909 A 2/2004
(Continued)

OTHER PUBLICATIONS

International Search Report dated Jul. 21, 2020 for WO 2020/241243 A1 (5 pages).

*Primary Examiner* — Jean F Duverne
(74) *Attorney, Agent, or Firm* — Venjuris, P.C.

(57) ABSTRACT

A terminal to be connected to a front end part of a flexible board including an insulating base film and a conductive path is provided with a terminal body including a sandwiching portion for sandwiching the flexible board and a tubular shell to be disposed outside sandwiching portion. The sandwiching portion includes a conductive contact portion for contacting the conductive path of the flexible board. The shell includes a pressurizing portion for pressing the sandwiching portion toward the flexible board, the pressurizing portion projecting inwardly of the shell. The shell includes a wide portion not formed with the pressurizing portion and a narrow portion narrower inside than the wide portion by being formed with the pressurizing portion. The narrow portion is located outside the sandwiching portion, whereby
(Continued)

the conductive contact portion of the sandwiching portion contacts the conductive path.

9 Claims, 8 Drawing Sheets

(56) References Cited

U.S. PATENT DOCUMENTS

| | | | | |
|---|---|---|---|---|
| 6,093,054 | A | 7/2000 | Merkle et al. | |
| 2002/0119710 | A1 | 8/2002 | Mello et al. | |
| 2003/0104732 | A1 | 6/2003 | Ferderer | |
| 2008/0009180 | A1* | 1/2008 | Ikuta ..... | H01R 12/592<br>439/495 |

FOREIGN PATENT DOCUMENTS

| | | | |
|---|---|---|---|
| JP | 2005-347143 | A | 12/2005 |
| JP | 2007-213868 | A | 8/2007 |
| JP | 2007-250264 | A | 9/2007 |
| JP | 2016-100070 | A | 5/2016 |

* cited by examiner

TERMINAL AND FLEXIBLE BOARD WITH TERMINAL

CROSS REFERENCE TO RELATED APPLICATIONS

This application is a national phase of PCT application No. PCT/JP2020/018965, filed on 12 May 2020, which claims priority from Japanese patent application No. 2019-100018, filed on 29 May 2019, all of which are incorporated herein by reference.

TECHNICAL FIELD

The present disclosure relates to a terminal and a flexible board with terminal.

BACKGROUND

Conventionally, a terminal to be connected to a flexible board illustrated by a flexible printed circuit (FPC) board is known from Japanese Patent Laid-Open Publication No. 2004-040909. In the FPC board, a circuit is formed on a base film. A connection terminal is joined to the circuit. The connection terminal is directly connected to the circuit of the FPC board by resistance welding, ultrasonic welding, laser welding or soldering.

PRIOR ART DOCUMENT

Patent Document

Patent Document 1: JP 2004-040909 A

SUMMARY OF THE INVENTION

Problems to be Solved

To connect the connection terminal and the circuit of the FPC board by resistance welding, ultrasonic welding or laser welding, a corresponding welding machine is necessary. Thus, manufacturing cost increases. Also in the case of connection by soldering, a soldering facility such as a reflow furnace is necessary, wherefore manufacturing cost increases.

The present disclosure was completed on the basis of the above situation and aims to provide a technique for the connection of a terminal and a flexible board with reduced manufacturing cost.

Means to Solve the Problem

The present disclosure is directed to a terminal to be connected to a front end part of a flexible board including an insulating base film and a conductive path formed on at least one of front and back surfaces of the base film, the terminal including a terminal body having a sandwiching portion for sandwiching the flexible board, and a tubular shell to be disposed outside sandwiching portion, wherein the sandwiching portion includes a conductive contact portion for contacting the conductive path of the flexible board, the shell includes a pressurizing portion for pressing the sandwiching portion toward the flexible board, the pressurizing portion projecting inwardly of the shell, the shell includes a wide portion not formed with the pressurizing portion and a narrow portion narrower inside than the wide portion by being formed with the pressurizing portion, and the narrow portion is located outside the sandwiching portion, whereby the conductive contact portion of the sandwiching portion contacts the conductive path.

Effect of the Invention

According to the present disclosure, it is possible to reduce manufacturing cost in connecting a terminal and a flexible board.

DETAILED DESCRIPTION TO EXECUTE THE INVENTION

Description of Embodiments of Present Disclosure

Figure 1:
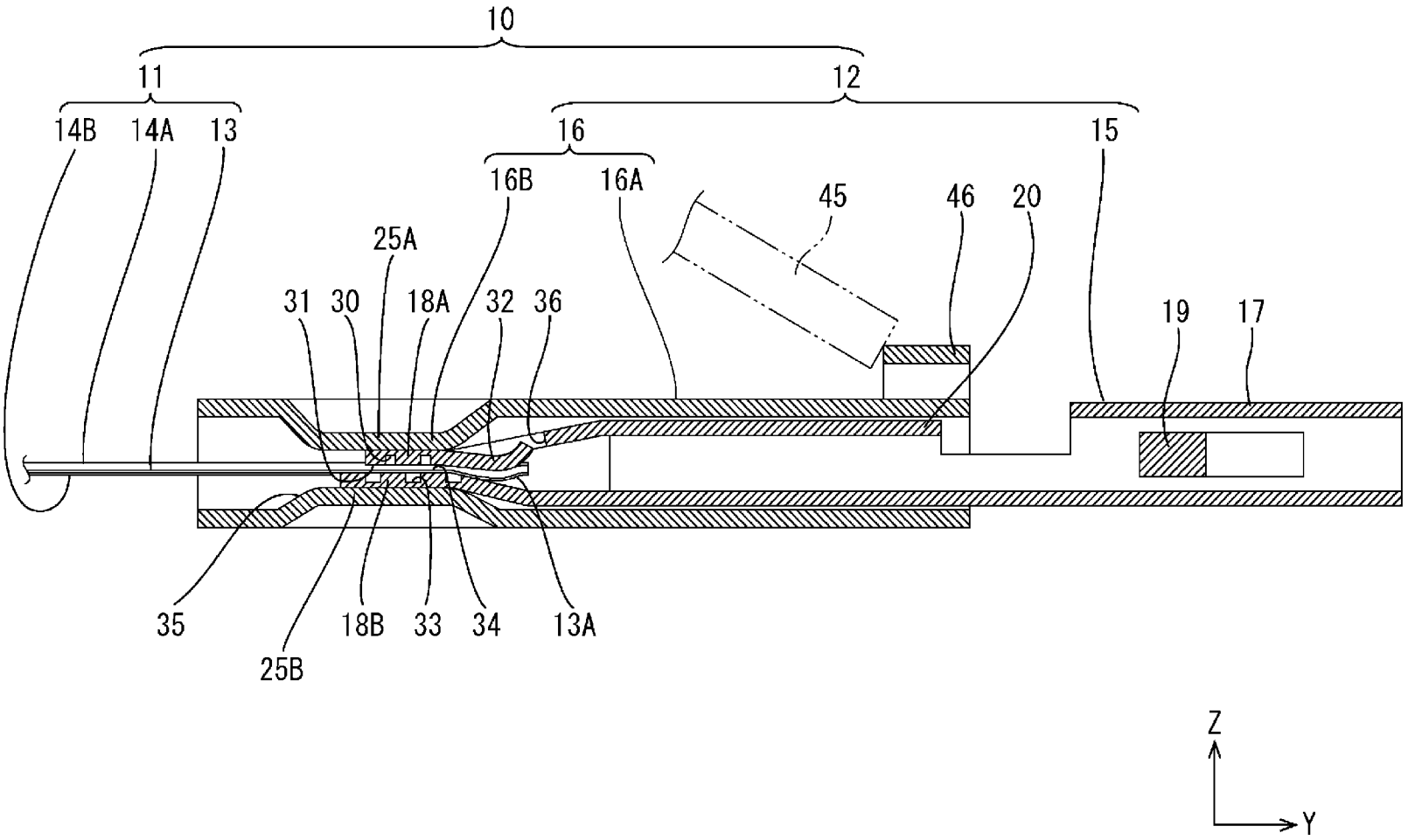
FIG. 1 is a section showing a flexible board with terminal according to a first embodiment.

First, embodiments of the present disclosure are listed and described.

(1) The terminal of the present disclosure is a terminal to be connected to a front end part of a flexible board including an insulating base film and a conductive path formed on at least one of front and back surfaces of the base film, and includes a terminal body having a sandwiching portion for sandwiching the flexible board, and a tubular shell to be disposed outside sandwiching portion, wherein the sandwiching portion includes a conductive contact portion for contacting the conductive path of the flexible board, the shell includes a pressurizing portion for pressing the sandwiching portion toward the flexible board, the pressurizing portion projecting inwardly of the shell, the shell includes a wide portion not formed with the pressurizing portion and a narrow portion narrower inside than the wide portion by being formed with the pressurizing portion, and the narrow portion is located outside the sandwiching portion, whereby the conductive contact portion of the sandwiching portion contacts the conductive path.

The pressurizing portion formed in the narrow portion presses the sandwiching portion toward the flexible board, whereby the conductive contact portion of the sandwiching portion contacts the conductive path of the flexible board. In this way, the terminal and the flexible board are electrically connected.

Since the terminal and the flexible board can be electrically connected by arranging the narrow portion of the shell outside the sandwiching portion, a large-scale facility such as a welding machine or reflow furnace is unnecessary. Thus, manufacturing cost can be reduced.

(2) Preferably, the terminal body includes two sandwiching portions located on sides of the front and back surfaces of the flexible board and the shell includes two pressurizing portions for respectively pressurizing the two sandwiching portions.

Since the front and back surfaces of the flexible board are sandwiched by the two sandwiching portions, the conductive path of the flexible board is sandwiched by the sandwiching portion with a larger force. In this way, the conductive path of the flexible board and the conductive contact portion of the sandwiching portion are more firmly held in contact, wherefore the electrical connection reliability of the flexible board and the terminal is improved.

The flexible board is guided to between the two sandwiching portions by sliding in contact with the two sandwiching portions. In this way, the efficiency of a connecting operation of the flexible board and the terminal can be improved.

(3) Preferably, one of the two sandwiching portions is provided with the conductive contact portion, and the other of the two sandwiching portions is provided with an insulated contact portion for contacting the base film of the flexible board.

By the contact of the conductive contact portion provided on the one sandwiching portion and the conductive path of the flexible board, the flexible board and the terminal are electrically connected. At this time, the insulated contact portion provided on the other sandwiching portion contacts the base film of the flexible board to press the base film, whereby the flexible board can be firmly held. Since position shifts of the conductive contact portion and the conductive path are suppressed in this way, the electrical connection reliability of the terminal and the flexible board can be further improved.

(4) Preferably, the pressurizing portion is formed with a guide slope inclined inwardly of the shell toward a front side in an extending direction of the conductive path on a rear side in the extending direction.

When the flexible board is inserted into the slide portion, a front end part of the flexible board slides in contact with the guide slope from behind, whereby the flexible board is guided into the slide portion. In this way, the efficiency of a connecting operation of the flexible board and the terminal can be improved.

(5) Preferably, the wide portion is provided on a front side of the shell in the extending direction of the conductive path and the narrow portion is provided on a rear side of the shell in the extending direction, and the shell is slidable between a first state where the wide portion is located outside the sandwiching portion and the pressurizing portion is not in contact with the sandwiching portion and a second state where the narrow portion is located outside the sandwiching portion and the pressurizing portion presses the sandwiching portion toward the flexible board.

The flexible board and the terminal can be electrically connected by a simple method of moving the slide portion from the first state to the second state.

(6) Preferably, both or one of the terminal body and the shell include(s) a partial locking portion for holding the terminal body and the shell in the first state and a full locking portion for holding the terminal body and the shell in the second state.

The terminal body and the shell are held in the first state by the partial locking portion. In this way, the terminal and the shell can be temporarily assembled in a state before the terminal is connected to the flexible board. Thus, the efficiency of a manufacturing operation of the terminal can be improved.

The terminal body and the shell are held in the second state by the full locking portion. Since the terminal and the flexible board can be held connected in this way, the electrical connection reliability of the terminal and the flexible board can be improved.

(7) Preferably, the sandwiching portion is formed with a resiliently deformable spring portion, and the flexible board is pressed by a resilient force of the spring portion.

Temperature may rise with the base film pressed by the sandwiching portion. Then, the base film is compressively deformed by being pressed by the sandwiching portion. If the temperature falls thereafter, there is a concern that the shape of the sandwiching portion is restored, but the shape of the base film is not completely restored. Then, a clearance may be formed between the sandwiching portion and the conductive path. Accordingly, in the present disclosure, the sandwiching portion is provided with the spring portion. In this way, even if the shape of the base film is not completely restored, the flexible board is further pressed by the resilient force of the spring portion, whereby the electrical connection of the sandwiching portion and the conductive path can be maintained.

(8) Preferably, the spring portion is in the form of a leaf spring extending forward from a rear side of the sandwiching portion in the extending direction of the conductive path.

When being inserted into the slide portion, the flexible board slides in contact with the spring portion, thereby being easily inserted into the slide portion. In this way, the efficiency of the connecting operation of the flexible board and the terminal can be improved.

(9) A flexible board with terminal of the present disclosure includes the terminal of any one of (1) to (8) described above, and a flexible board to be connected to the terminal.

Details of Embodiments of Present Disclosure

Hereinafter, embodiments of the present disclosure are described. The present invention is not limited to these illustrations and intended to be represented by claims and include all changes in the scope of claims and in the meaning and scope of equivalents.

First Embodiment

A first embodiment of the present disclosure is described with reference to FIGS. 1 to 5. A flexible board with terminal 10 according to this embodiment includes a flexible board 11 and a terminal 12 connected to the flexible board 11. The terminal 12 is connected to an unillustrated mating terminal. As shown in FIG. 1, the terminal 12 is connected to a front end part of a flexible board 11 in an extending direction (direction indicated by an arrow Y). In the following description, a direction indicated by an arrow Z is referred to as an upward direction, the direction indicated by the arrow Y is referred to as a forward direction, and a direction indicated by an arrow X is referred to as a leftward direction. Note that, for a plurality of identical members, only some may be denoted by a reference sign and the others may not be denoted by the reference sign.

[Flexible Board 11]

Figure 2:
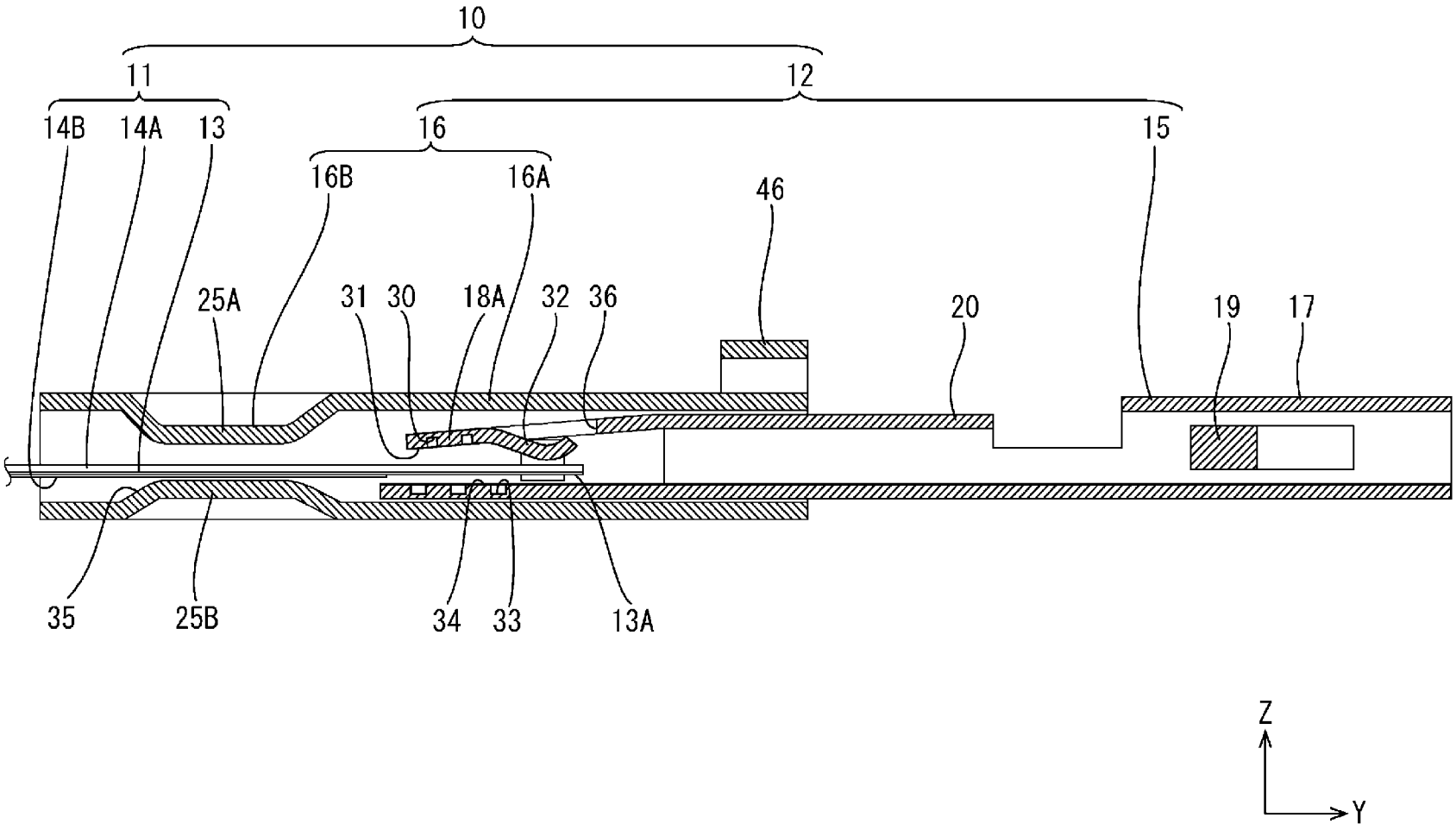
FIG. 2 is a section showing a state where a flexible board is inserted in a slide portion and a terminal body with the slide portion partially locked to the terminal body.

The flexible board 11 according to this embodiment is a so-called flexible printed circuit board. As shown in FIG. 2, the flexible board 11 is disposed to extend in a front-rear direction. The flexible board 11 includes a base film 14A, a conductive path 13 formed on the lower surface of the base film 14A, and a coverlay 14B laid on a region of the conductive path 13 except a land 13A. Note that, in FIGS. 1 and 2, thicknesses of the flexible board 11, the base film 14A, the conductive path 13 and the coverlay 14B are schematically shown in an exaggerated manner.

The base film 14A is made of insulating synthetic resin such as polyethylene terephthalate (PET), polyethylene naphthalate (PEN) or polyimide (PI).

The conductive path 13 is formed by forming a conductive material such as a copper foil into a predetermined shape by a known method such as etching on the front or back surface of the base film 14A. The conductive path 13 is formed to extend in the front-rear direction (an example of an extending direction) along the flexible board 11.

The coverlay 14B is not particularly limited and may be, for example, formed by screen-printing a film made of synthetic resin such as polyimide or an ink-like protection material on a circuit.

The coverlay 14B is not formed in a front end part of the lower surface of the flexible board 11 to expose the conductive path 13. A part of the conductive path 13 exposed from the coverlay 14B serves as the land 13A.

[Terminal 12]

As shown in FIGS. 1 and 2, the terminal 12 includes a terminal body 15 made of metal and a slide portion 16 (an example of a shell) relatively slidable with respect to the terminal body 15.

[Terminal Body 15]

Figure 3:
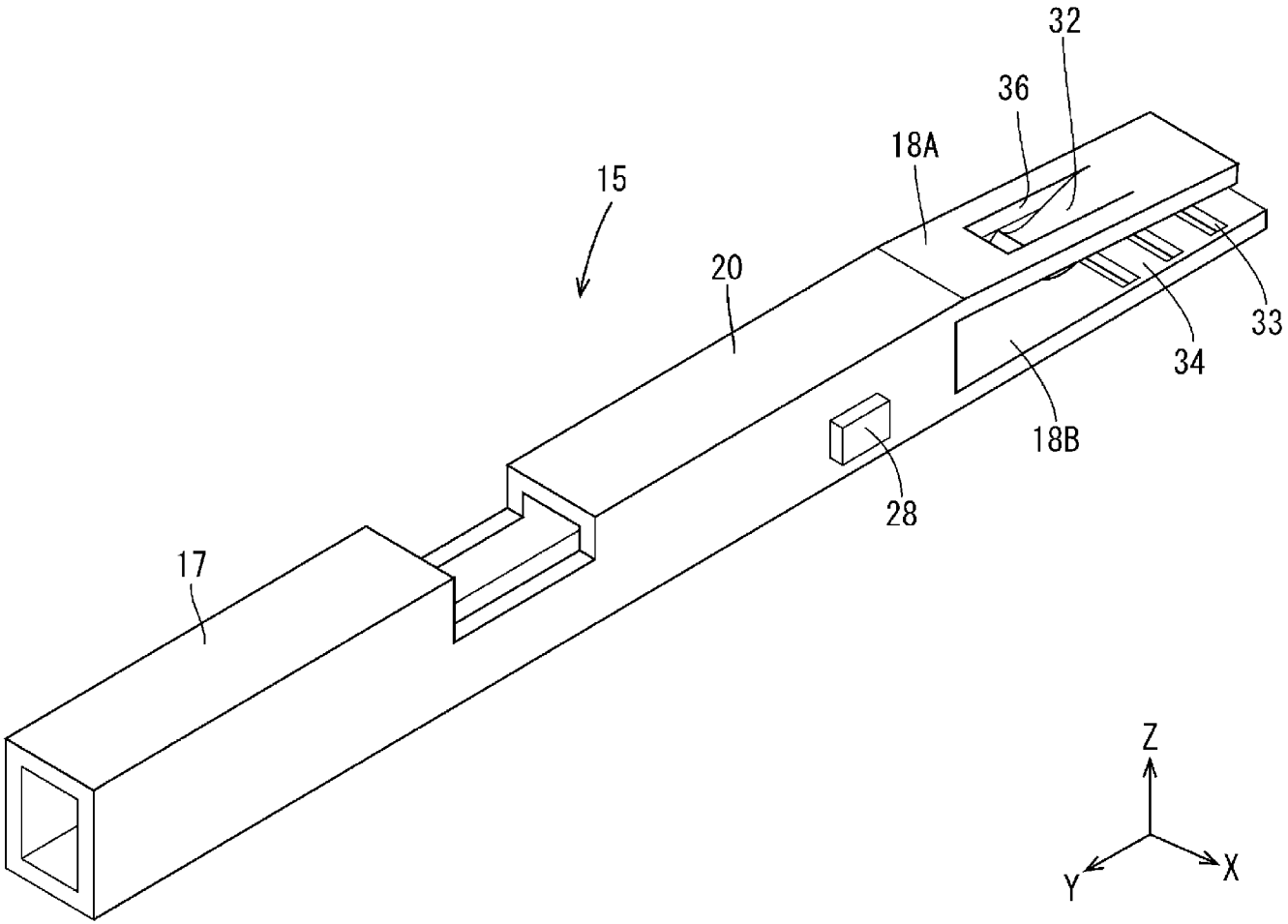
FIG. 3 is a perspective view showing the terminal body.

As shown in FIG. 3, the terminal body 15 is formed into a predetermined shape by a known method such as press-working, cutting or casting. An arbitrary metal such as copper, copper alloy, aluminum, aluminum alloy or stainless steel can be appropriately selected, if necessary, as the metal constituting the terminal body 15. The terminal body 15 according to this embodiment is made of copper or copper alloy. A plating layer may be formed on the surface of the terminal body 15. An arbitrary metal such as tin, nickel or silver can be appropriately selected, if necessary, as a metal constituting the plating layer. Tin plating is applied to the terminal body 15 according to this embodiment.

As shown in FIG. 3, the terminal body 15 includes a tube portion 17 into which a plate-like mating terminal is insertable, and a flexible board connecting portion 20 located behind the tube portion 17 and to be connected to the flexible board 11. The flexible board connecting portion 20 includes an upper sandwiching portion 18A and a lower sandwiching portion 18B extending rearward. The terminal 12 according to this embodiment is a so-called female terminal, and the mating terminal is a so-called male terminal.

As shown in FIG. 3, the tube portion 17 is in the form of a rectangular tube extending in the front-rear direction. The front end of the tube portion 17 is open so that the mating terminal is insertable. A resiliently deformable resilient contact piece 19 is disposed inside the tube portion 17 (see FIG. 1). The resilient contact piece 19 extends inward from the inner wall of the tube portion 17. The mating terminal inserted into the tube portion 17 presses and resiliently deforms the resilient contact piece 19. By a resilient force of the resiliently deformed resilient contact piece 19, the mating terminal is sandwiched between the inner wall of the tube portion 17 and the resilient contact piece 19. In this way, the mating terminal and the terminal 12 are electrically connected.

As shown in FIG. 2, the flexible board connecting portion 20 in the form of a rectangular tube is provided behind the tube portion 17. The upper sandwiching portion 18A (an example of a sandwiching portion) is provided to extend rearward on a rear end part of the upper wall of the flexible board connecting portion 20, and the lower sandwiching portion 18B (an example of the sandwiching portion) is provided to extend rearward on a rear end part of the lower wall of the flexible board connecting portion 20. The upper and lower sandwiching portions 18A, 18B have a shape elongated in the front-rear direction. A rear end part of the lower sandwiching portion 18B extends somewhat more rearward than that of the upper sandwiching portion 18A.

As shown in FIG. 2, a plurality of (two in this embodiment) upper serrations 30 are formed side by side at positions near the rear end part on the lower surface of the upper sandwiching portion 18A while being spaced apart in the front-rear direction. The upper serrations 30 are in the form of grooves extending in the lateral direction. A region of the upper sandwiching portion 18A where the upper serrations 30 are formed serves as an insulated contact portion 31 for contacting the base film 14A.

As shown in FIGS. 2 and 3, the upper sandwiching portion 18A is formed with an upper spring portion 32 in front of the upper serrations 30. The upper spring portion 32 is in the form of a leaf spring elongated forward with a rear end part as a base end part. A front end part of the upper spring portion 32 is a free end. The upper sandwiching portion 18A is formed with an upper slit 36 extending on both left and right sides of and in front of the upper spring portion 32. The upper spring portion 32 is bent into a valley shape concave downward in a side view. The upper spring portion 32 is resiliently deformable in the vertical direction, and a lowermost part of the valley shape presses the flexible board 11 from above.

As shown in FIG. 2, a plurality of (three in this embodiment) lower serrations 33 are formed side by side at positions near the rear end part on the upper surface of the lower sandwiching portion 18B while being spaced apart in the front-rear direction. The lower serrations 33 and the upper serrations 30 are arranged to deviate from each other in the front-rear direction. A region of the lower sandwiching portion 18B where the lower serrations 33 are formed serves as a conductive contact portion 34 to be electrically connected to the land 13A of the flexible board 11.

As shown in FIG. 3, a locking projection 28 (an example of a partially locking portion, an example of a fully locking portion) projecting outward is formed on a side wall of the terminal body 15. This locking projection 28 holds the slide portion 16 at a partial locking position and a full locking position by locking a partial lock receiving portion 26 (an example of the partially locking portion) and a full lock receiving portion 27 (an example of the fully locking portion) to be described later.

[Slide Portion 16]

Figure 4:
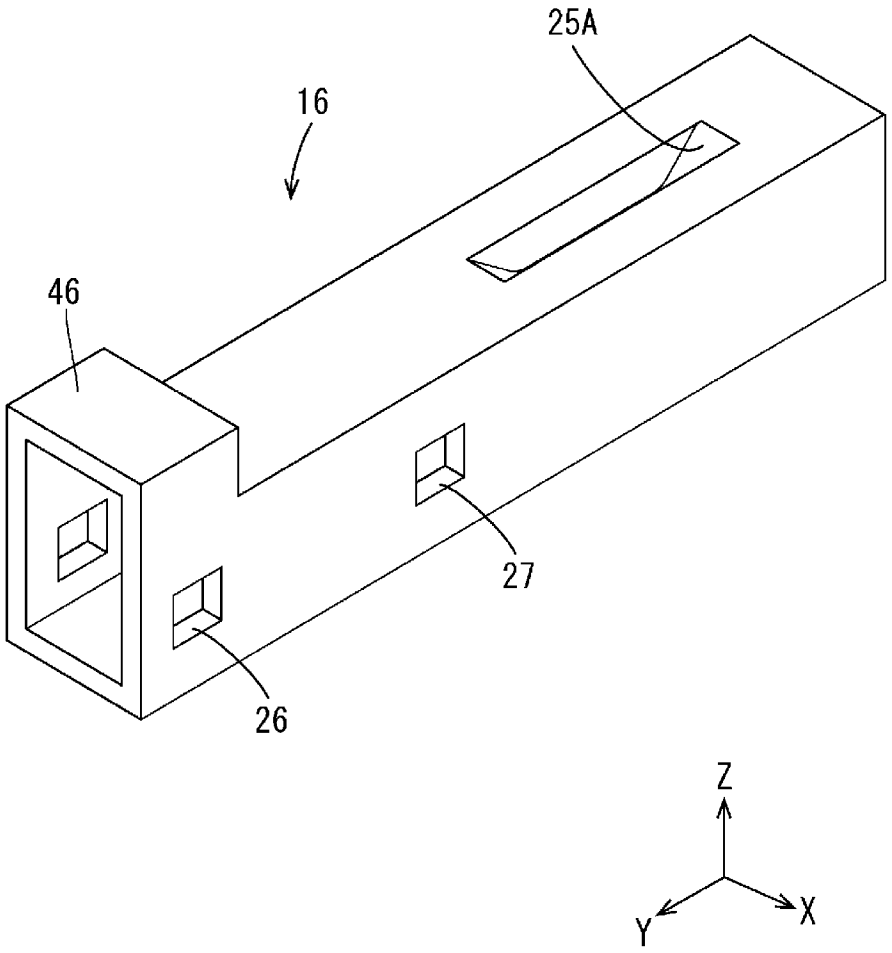
FIG. 4 is a perspective view showing the slide portion.

As shown in FIG. 4, the slide portion 16 is in the form of a rectangular tube extending in the front-rear direction. The slide portion 16 is formed by a known method such as cutting, casting or press-working, if necessary. An arbitrary metal such as copper, copper alloy, aluminum, aluminum alloy or stainless steel can be appropriately selected, if necessary, as the metal constituting the slide portion 16. The slide portion 16 according to this embodiment is made of stainless steel. A plating layer may be formed on the surface of the slide portion 16. An arbitrary metal such as tin, nickel or silver can be appropriately selected, if necessary, as a metal constituting the plating layer.

A cross-sectional shape of the inner surface of the slide portion 16 is the same as or somewhat larger than an outer cross-sectional shape of a region where the upper and lower sandwiching portions 18A, 18B are provided. In this way, the slide portion 16 is disposed outside the region of the terminal body 15 where the upper and lower sandwiching portions 18A, 18B are provided.

As shown in FIG. 2, an upper pressurizing portion 25A (an example of a pressurizing portion) projecting downward is provided on the lower surface of the upper wall of the slide portion 16. A lower pressurizing portion 25B (an example of the pressurizing portion) projecting upward is provided on the upper surface of the lower wall of the slide portion 16.

A region of the slide portion 16 forward of a part where the upper and lower pressurizing portions 25A, 25B are formed serves as a wide portion 16A. The part of the slide portion 16 where the upper and lower pressurizing portions 25A, 25B are formed serves as a narrow portion 16B narrower in the vertical direction than the inner shape of the wide portion 16A.

A guide slope 25 inclined upward toward a front side is formed on a rear side of the lower pressurizing portion 25B. The front end part of the flexible board 11 slides in contact with this guide slope 35, whereby the flexible board 11 is guided to between the upper and lower sandwiching portions 18A and 18B.

As shown in FIG. 4, the partial lock receiving portion 26 is open at a position near a front end part in the front-rear direction in a side wall of the slide portion 16. Further, the full lock receiving portion 27 is open at a position behind the partial lock receiving portion 26 in the side wall of the slide portion 16. The partial lock receiving portion 26 and the full lock receiving portion 27 can be resiliently locked to the locking projection 28 provided on the side wall of the terminal body 15.

With the locking projection 28 of the terminal body 15 and the partial lock receiving portion 26 of the slide portion 16 locked, the slide portion 16 is held at the partial locking position (an example of a first state) with respect to the terminal body 15 (see FIG. 2). In this state, the wide portion 16A is located outside the upper and lower sandwiching portions 18A, 18B. In this way, the upper and lower pressurizing portions 25A, 25B of the slide portion 16 are separated rearward from the rear end edges of the upper and lower sandwiching portions 18A, 18B. Further, in this state, an interval between the upper and lower sandwiching portions 18A, 18B is set larger than a thickness of the flexible board 11 (see FIG. 2).

Figure 5:
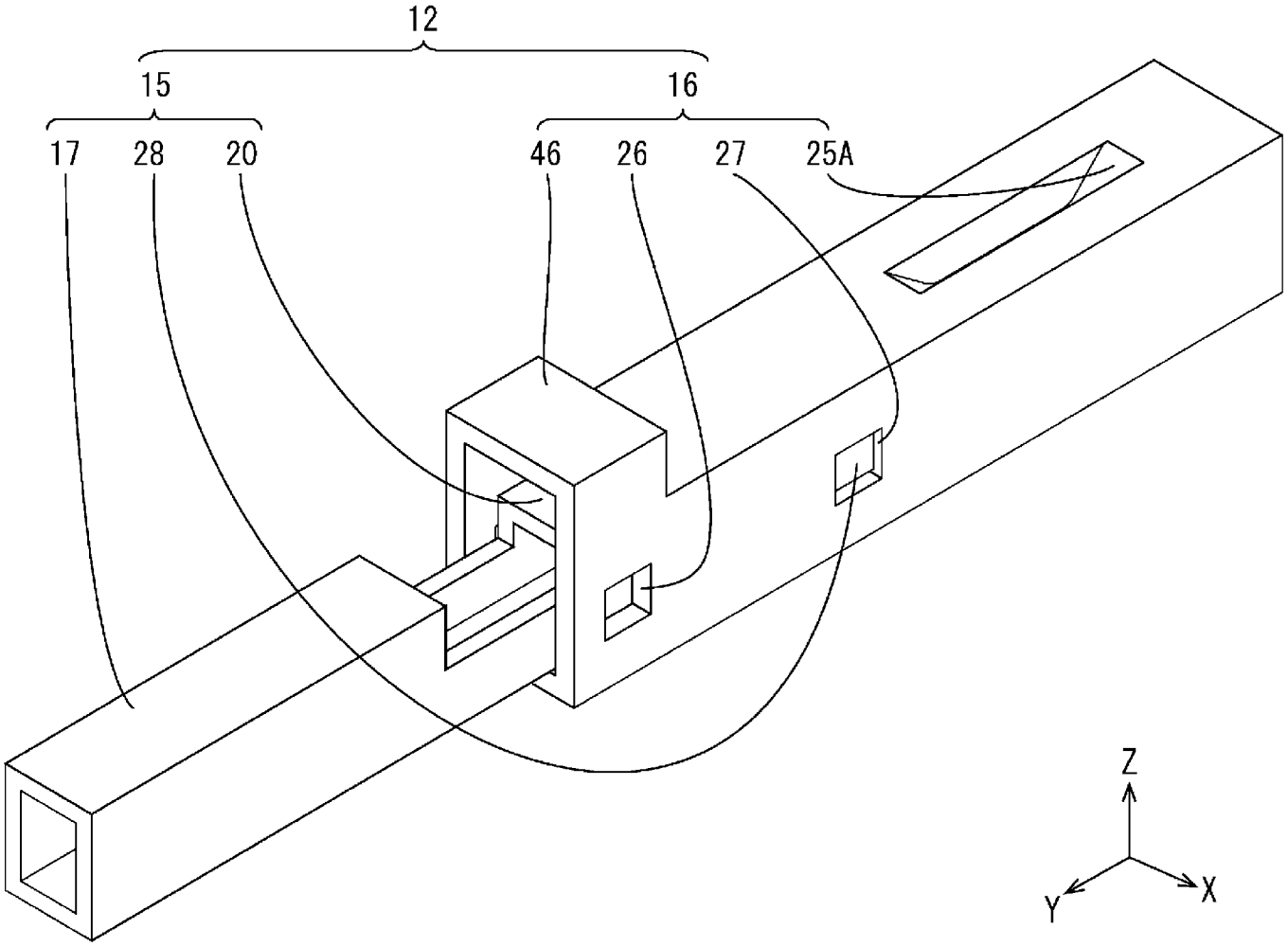
FIG. 5 is a perspective view showing a state where the slide portion is fully locked to the terminal body.

As shown in FIG. 5, with the locking projection 28 of the terminal body 15 and the full lock receiving portion 27 of the slide portion 16 locked, the slide portion 16 is held at the full locking position (an example of a second state) with respect to the terminal body 15. In this state, the narrow portion 16B is located outside the upper and lower sandwiching portions 18A, 18B. In this way, the upper pressurizing portion 25A of the slide portion 16 is in contact with the upper sandwiching portion 18A from above the upper sandwiching portion 18A. Further, the lower pressurizing portion 25B of the slide portion 16 is in contact with the lower sandwiching portion 18B from below the lower sandwiching portion 18B (see FIG. 1).

As described above, the slide portion 16 is slidable between the partial locking position and the full locking position described above while being externally fit to the region of the terminal body 15 where the upper and lower sandwiching portions 18A, 18B are provided.

As shown in FIG. 1, with the slide portion 16 held at the full locking position with respect to the terminal body 15, the upper pressurizing portion 25A presses the upper sandwiching portion 18A from above, whereby the upper sandwiching portion 18A is deformed downward. Further, the lower pressurizing portion 25B presses the lower sandwiching portion 18B from below, whereby the lower sandwiching portion 18B is deformed upward.

In a state where the flexible board 11 is disposed to extend in the front-rear direction (extending direction) in a space between the upper and lower sandwiching portions 18A and 18B and the slide portion 16 is held at the full locking position with respect to the terminal body 15, the front end part of the flexible board 11 is vertically sandwiched by the resiliently deformed upper and lower sandwiching portions 18A, 18B. That is, the upper sandwiching portion 18A contacts the flexible board 11 from above by being pressed downward by the upper pressurizing portion 25A, and the lower sandwiching portion 18B contacts the flexible board 11 from below by being pressed upward by the lower pressurizing portion 25B.

As shown in FIG. 1, with the slide portion 16 held at the full locking position with respect to the terminal body 15, the upper sandwiching portion 18A presses the upper surface of the flexible board 11 (an example of a front surface of the flexible board 11) from above. In this way, the upper serrations 30 formed on the upper sandwiching portion 18A bite into the base film 14A of the flexible board 11 from above. As a result, the flexible board 11 is firmly held by the upper sandwiching portion 18A.

With the slide portion 16 held at the full locking position with respect to the terminal body 15, the lower sandwiching portion 18B presses the land 13A formed on the lower surface of the flexible board 11 (an example of a back surface of the flexible board 11) from below. In this way, the lower serrations 33 provided on the lower sandwiching portion 18B bite into the land 13A while breaking an oxide film formed on the surface of the land 13A. In this way, the contact portion of the lower sandwiching portion 18A and the land 13A are electrically connected.

As shown in FIG. 1, a jig contact portion 46 projecting upward from the upper wall is provided on a front end part of the slide portion 16. A jig 45 contacts the jig contact portion 46 from behind to press the slide portion 16 forward, whereby the slide portion 16 is movable forward.

As shown in FIG. 1, with the slide portion 16 held at the full locking position with respect to the terminal body 15, the upper spring portion 32 formed in the upper sandwiching portion 18A is located forward of the upper and lower pressurizing portions 25A, 25B. In this way, pressing forces from the upper and lower pressurizing portions 25A, 25B are not applied to the upper spring portion 32.

The upper spring portion 32 contacts the flexible board 11 from above. In this way, the flexible board 11 is biased downward by a resilient force of the upper spring portion 32. As a result, the land 13A formed on the lower surface of the flexible board 11 is biased against the contact portion of the lower sandwiching portion 18B.

[Connection Process of Flexible Board 11 and Terminal 12]

Next, an example of a connection process of the flexible board 11 and the terminal 12 is described. The connection process of the flexible board 11 and the terminal 12 is not limited to the one described below.

The terminal body 15 and the slide portion 16 are formed by known methods. The slide portion 16 is assembled with the terminal body 15 from behind. The front end edge of the slide portion 16 comes into contact with the locking projection 28 of the terminal body 15 from behind, whereby the side wall of the slide portion 16 is expanded and deformed. When the slide portion 16 is further pushed forward, the side wall of the slide portion 16 is restored and the locking projection 28 of the terminal body 15 is locked to the partial lock receiving portion 26 of the slide portion 16. In this way, the slide portion 16 is held at the partial locking position with respect to the terminal body 15. In this way, the terminal 12 is obtained.

The conductive path 13 is formed on the lower surface of the base film 14A by a known method, and the coverlay 14B is further laminated. The land 13A of the conductive path 13 is exposed from the front end part of the coverlay 14B.

When the flexible board 11 is pushed forward through the rear end part of the slide portion 16, the front end part of the flexible board 11 is introduced into the slide portion 16 through the rear end part of the slide portion 16. When the flexible board 11 is further pushed forward, the front end part of the flexible board 11 enters the terminal body 15 and reaches the space between the upper and lower sandwiching portions 18A, 18B (see FIG. 2).

As shown in FIG. 2, with the slide portion 16 held at the partial locking position with respect to the terminal body 15, the interval between the upper and lower sandwiching portions 18A, 18B is set larger than the thickness of the flexible board 11. With the flexible board 11 inserted in the slide portion 16, the flexible board 11 extends in the front-rear direction and the conductive path 13 formed on this flexible board 11 also extends in the front-rear direction.

Subsequently, the jig 45 is brought into contact with the jig contact portion 46 from behind and the slide portion 16 is slid forward. The slide portion 16 is relatively moved forward with respect to the terminal body 15. At this time, locking between the locking projection 28 of the terminal body 15 and the partial lock receiving portion 26 of the slide portion 16 is released and the side wall of the slide portion 16 rides on the locking projection 28 to be expanded and deformed.

When the slide portion 16 is moved forward, the side wall of the slide portion 16 is restored and the locking projection 28 of the terminal body 15 and the full lock receiving portion 27 of the slide portion 16 are resiliently locked. In this way, the slide portion 16 is held at the full locking position with respect to the terminal body 15.

With the slide portion 16 held at the full locking position with respect to the terminal body 15, the upper pressurizing portion 25A of the slide portion 16 comes into contact with the upper sandwiching portion 18A of the terminal body 15 from above to press the upper sandwiching portion 18A downward. Further, the lower pressurizing portion 25B of the slide portion 16 comes into contact with the lower sandwiching portion 18B of the terminal body 15 from below to press the lower sandwiching portion 18B upward. In this way, the flexible board 11 is sandwiched from upper and lower sides, i.e. has both front and back surfaces thereof sandwiched, by the upper and lower sandwiching portions 18A, 18B.

As shown in FIG. 1, with the slide portion 16 held at the full locking position with respect to the terminal body 15, the upper sandwiching portion 18A presses the flexible board 11 from above. In this way, the upper serrations 30 formed on the upper sandwiching portion 18A bite into the base film 14A of the flexible board 11 from above. As a result, the flexible board 11 is firmly held by the upper sandwiching portion 18A. Thus, a holding force of the flexible board 11 and the terminal 12 can be enhanced when a pulling force is applied to the flexible board 11.

With the slide portion 16 held at the full locking position with respect to the terminal body 15, the lower sandwiching portion 18B presses the land 13A of the flexible board 11 from below. In this way, the lower serrations 33 formed on the lower sandwiching portion 18B bite into the land 13A while breaking the oxide film formed on the surface of the land 13A. In this way, the contact portion of the lower sandwiching portion 18B and the land 13A are electrically connected. In the above way, the flexible board with terminal 10 is completed.

Functions and Effects of Embodiment

Next, functions and effects of this embodiment are described. This embodiment relates to the terminal 12 to be connected to the front end part of the flexible board 11 including the insulating base film 14A and the conductive path 13 formed on the lower surface of the base film 14A, the terminal 12 includes the terminal body 15 having the upper and lower sandwiching portions 18A, 18B for sandwiching the flexible board 11 and the tubular slide portion 16 to be disposed outside the upper and lower sandwiching portions 18A, 18B, the lower sandwiching portion 18B includes the conductive contact portion 34 for contacting the land 13A of the conductive path 13 formed on the flexible board 11, the slide portion 16 includes the upper and lower pressurizing portions 25A, 25B for respectively pressing the upper and lower sandwiching portions 18A, 18B toward the flexible board 11, the upper and lower pressurizing portions 25A, 25B project inwardly of the slide portion 16, the slide portion 16 includes the wide portion 16A not formed with the upper and lower pressurizing portions 25A, 25B and the narrow portion 16B narrower inside than the wide portion 16A by being formed with the upper and lower pressurizing portions 25A, 25B, and the narrow portion 16B is located outside the sandwiching portions, whereby the conductive contact portion 34 of the lower sandwiching portion 18B contacts the conductive path 13.

Further, the flexible board with terminal 10 according to this embodiment includes the above terminal 12 and the flexible board 11 to be connected to the terminal 11.

The upper and lower pressurizing portions 25A, 25B formed in the narrow portion 16B press the upper and lower sandwiching portions 18A, 18B toward the flexible board 11, whereby the conductive contact portion 34 of the lower sandwiching portion 34 contacts the conductive path 13 of the flexible board 11. In this way, the terminal 12 and the flexible board 11 are electrically connected.

Since the terminal 12 and the flexible board 11 can be electrically connected by arranging the narrow portion 16B of the slide portion 16 outside the upper and lower sandwiching portions 18A, 18B, a large-scale facility such as a welding machine or reflow furnace is unnecessary. Thus, manufacturing cost can be reduced.

Since the terminal 12 and the flexible board 11 are not soldered, the occurrence of troubles due to soldering such solder cracks can be suppressed. In this way, the electrical connection reliability of the terminal 12 and the flexible board 11 can be improved.

Since the terminal 12 and the flexible board 11 are not soldered, a heating process by a reflow furnace is unnecessary. In this way, a reduction in the spring performance of the resilient contact piece 19 can be suppressed.

According to this embodiment, the terminal body 15 includes the upper and lower sandwiching portions 18A, 18B respectively located on the sides of the front and back surfaces of the flexible board 11, and the slide portion 16 includes the upper and lower pressurizing portions 25A, 25B for respectively pressurizing the upper and lower sandwiching portions 18A, 18B.

Since the front and back surfaces of the flexible board 11 are sandwiched by the upper and lower sandwiching portions 18A, 18B, a force for sandwiching the conductive path 13 of the flexible board 11 by the upper and lower sandwiching portions 18A, 18B is larger as compared to the case where only one sandwiching portion is provided. Since the conductive path 13 of the flexible board 11 and the conductive contact portion 34 of the lower sandwiching portion 18B are more firmly held in contact in this way, the electrical connection reliability of the terminal 12 and the flexible board 11 can be improved.

The flexible board 11 is guided to between the upper and lower sandwiching portions 18A, 18B by sliding in contact with the upper and lower sandwiching portions 18A, 18B. In this way, the efficiency of a connecting operation of the flexible board 11 and the terminal 12 can be improved.

According to this embodiment, the lower sandwiching portion 18B is provided with the conductive contact portion 34, and the upper sandwiching portion 18A is provided with the insulated contact portion 31 for contacting the base film 14A of the flexible board 11.

By the contact of the conductive contact portion 34 provided on the lower sandwiching portion 18B and the conductive path 13 of the flexible board 11, the flexible board 11 and the terminal 12 are electrically connected. At this time, the insulated contact portion 31 provided on the upper sandwiching portion 18A contacts the base film 14A of the flexible board 11 to press the base film 14A, whereby the flexible board 11 can be firmly held. Since position shifts of the conductive contact portion 34 and the conductive path 13 are suppressed in this way, the electrical connection reliability of the terminal 12 and the flexible board 11 can be further improved.

According to this embodiment, the lower pressurizing portion 25B is formed with the guide slope 35 inclined inwardly of the slide portion 16 toward the front side in the extending direction of the conductive path 13 on the rear side in the extending direction.

When the flexible board 11 is inserted into the slide portion 16, the front end part of the flexible board 11 slides in contact with the guide slope 35 from behind, whereby the flexible board 11 is guided into the slide portion 16. In this way, the efficiency of the connecting operation of the flexible board 11 and the terminal 12 can be improved.

According to this embodiment, the wide portion 16A is provided on the front side of the slide portion 16 in the extending direction of the conductive path 13, the narrow portion 16B is provided on the rear side of the slide portion 16 in the extending direction, and the slide portion 16 slides between the first state where the wide portion 16A is located outside the upper and lower sandwiching portions 18A, 18B and the upper and lower pressurizing portions 25A, 25B are not in contact with the upper and lower sandwiching portions 18A, 18B and the second state where the narrow portion 16B is located outside the upper and lower sandwiching portions 18A, 18B and the upper and lower pressurizing portions 25A, 25B press the upper and lower sandwiching portions 18A, 18B toward the flexible board 11.

The flexible board 11 and the terminal 12 can be electrically connected by a simple method of moving the slide portion 16 from the first state to the second state.

According to this embodiment, the terminal body 15 includes the locking projection 28, and the slide portion 16 includes the partial lock receiving portion 26 for holding the terminal body 15 and the slide portion 16 in the first state and the full lock receiving portion 27 for holding the terminal body 15 and the slide portion 16 in the second state.

The terminal body 15 and the slide portion 16 are held in the first state by locking the locking projection 28 and the partial lock receiving portion 26. In this way, since the terminal body 15 and the slide portion 16 can be temporarily assembled in a state before the terminal 12 is connected to the flexible board 11, the efficiency of a manufacturing operation of the terminal 12 can be improved.

The terminal body 15 and the 16 slide portion are held in the second state by locking the locking projection 28 and the full lock receiving portion 27. In this way, since the terminal 12 and the flexible board 11 can be held connected, the efficiency of the connecting operation of the flexible board 11 and the terminal 12 can be improved.

According to this embodiment, the upper sandwiching portion 18A is formed with the resiliently deformable upper spring portion 32, and the flexible board 11 is pressed downward by the resilient force of the upper spring portion 32.

Temperatures of the terminal 12 and the flexible board 11 may rise with the base film 14A pressed by the upper and lower sandwiching portions 18A, 18B. Then, the base film 14A is compressively deformed by being pressed by the upper and lower sandwiching portions 18A, 18B. If the temperatures fall thereafter, there is a concern that the shapes of the upper and lower sandwiching portions 18A, 18B are restored, but the shape of the base film 14A is not completely restored. Then, a clearance may be formed between the conductive contact portion 34 of the lower sandwiching portion 18B and the conductive path 13. Accordingly, in this embodiment, the upper sandwiching portion 18A is provided with the upper spring portion 32. In this way, even if the shape of the base film 14A is not completely restored, the flexible board 11 can be pressed downward by the resilient force of the upper spring portion 32, whereby the electrical connection of the conductive contact portion 34 of the lower sandwiching portion 18B and the conductive path 13 can be maintained.

According to this embodiment, the upper spring portion 32 is in the form of a leaf spring extending forward from the rear side of the upper sandwiching 18A in the extending direction of the conductive path 13.

When being inserted into the slide portion 16, the flexible board 11 slides in contact with the upper spring portion 32, thereby being easily inserted into the slide portion 16. In this way, the efficiency of the connecting operation of the flexible board 11 and the terminal 12 can be improved.

Second Embodiment

Figure 6:
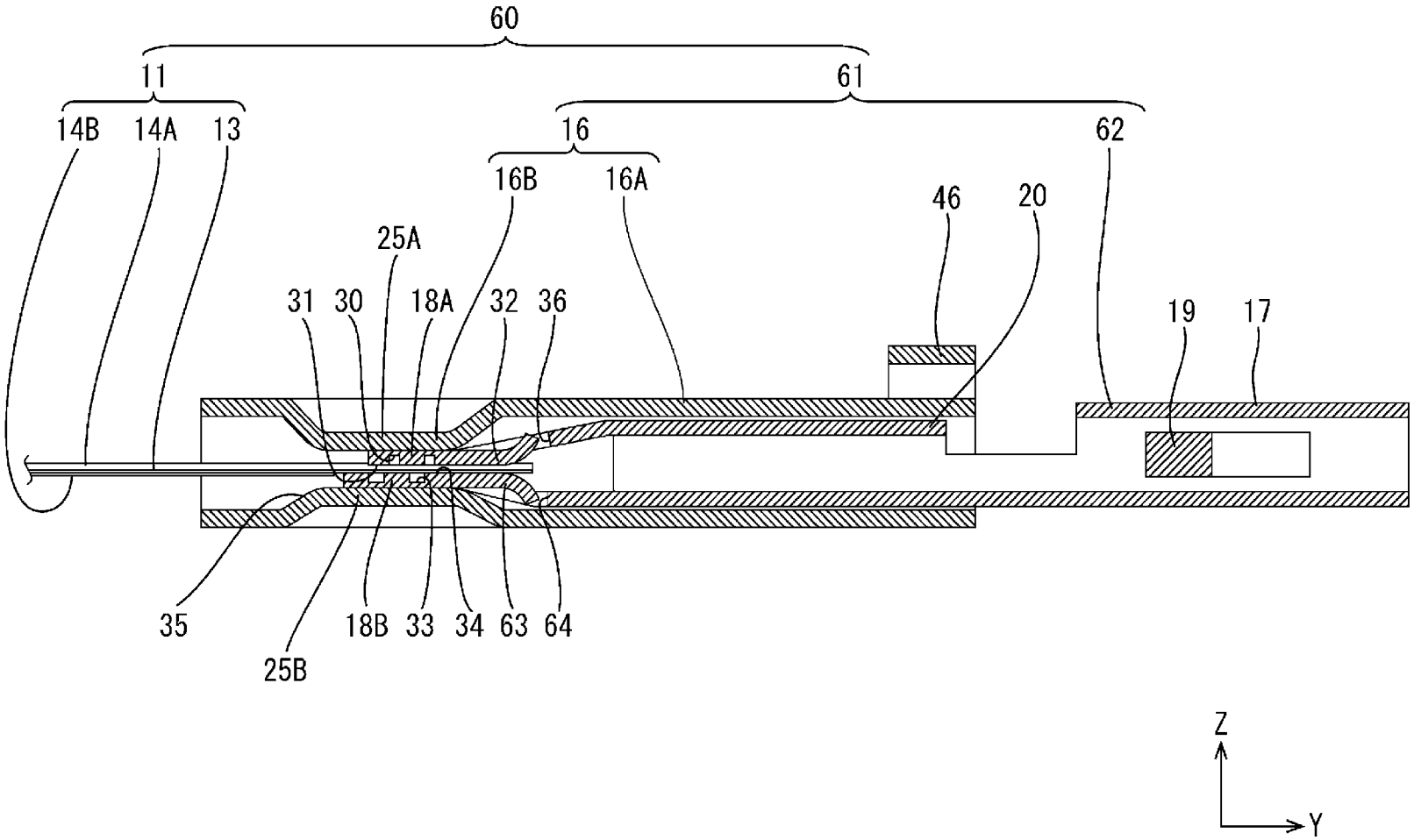
FIG. 6 is a section showing a flexible board with terminal according to a second embodiment.

Next, a second embodiment of the present disclosure is described with reference to FIG. 6. In a flexible board with terminal 60 according to this embodiment, a terminal body 62 of a terminal 61 is formed with a lower spring portion 63 at a position of a lower sandwiching portion 18B forward of lower serrations 33. The lower spring portion 63 is in the form of a leaf spring having a rear end part serving as a base end part and a front end part serving as a free end. The lower spring portion 63 is formed at a position corresponding to an upper spring portion 32. The lower sandwiching portion 18B is formed with a lower slit 64 extending on both left and right sides of and in front of the lower spring portion 63.

Since the other components are substantially the same as in the first embodiment, the same members are denoted by the same reference signs and repeated description is omitted.

According to this embodiment, since both front and back surfaces of a flexible board 11 are sandwiched by the upper and lower spring portions 32, 63, a position shift is suppressed even if a pulling force is applied to the flexible board 11. In this way, the electrical connection reliability of the terminal 61 and the flexible board 11 can be improved.

Third Embodiment

Figure 7:
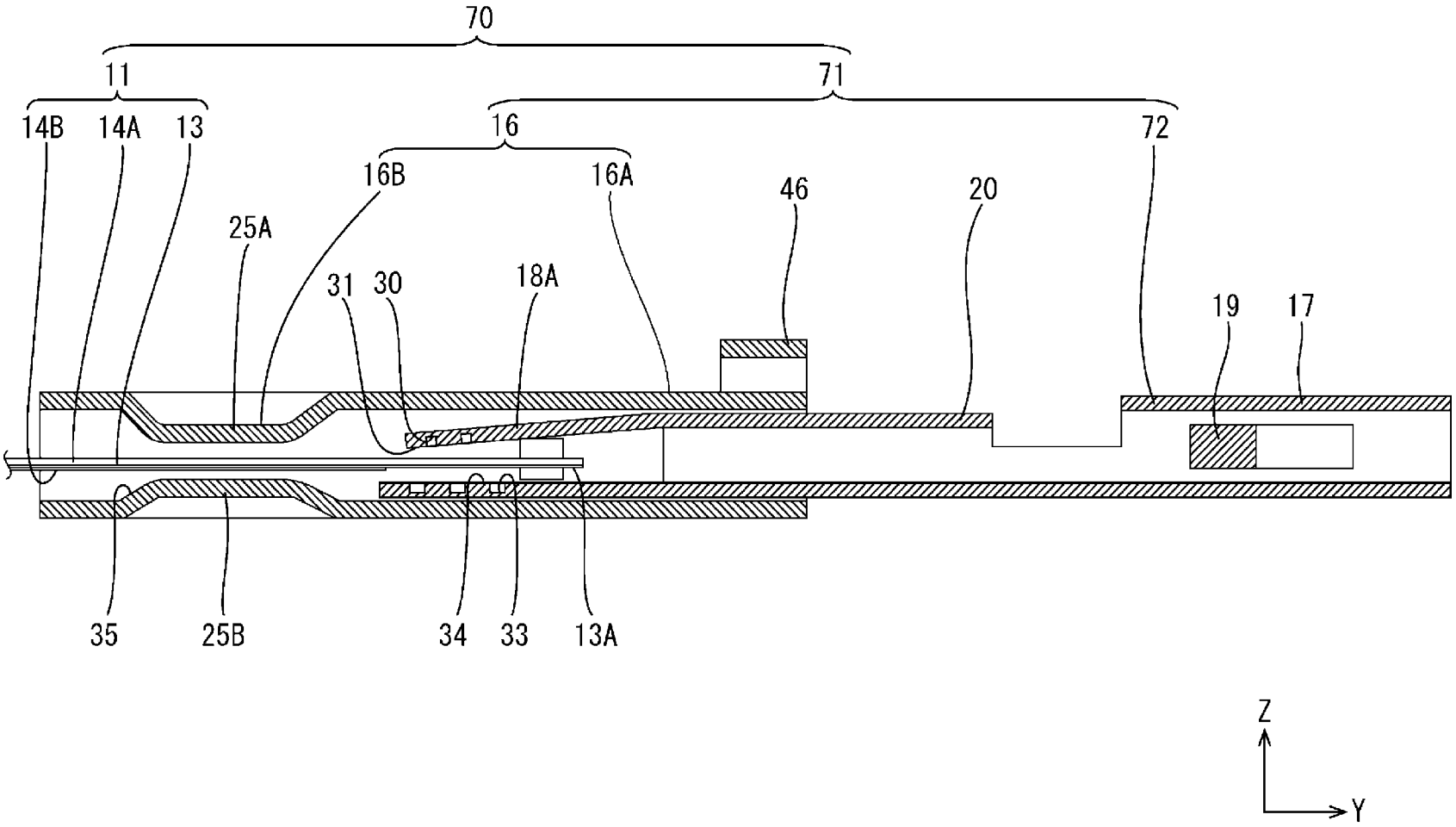
FIG. 7 is a section showing a state according to a third embodiment where a flexible board is inserted in a slide portion and a terminal body with the slide portion partially locked to the terminal body.
Figure 8:
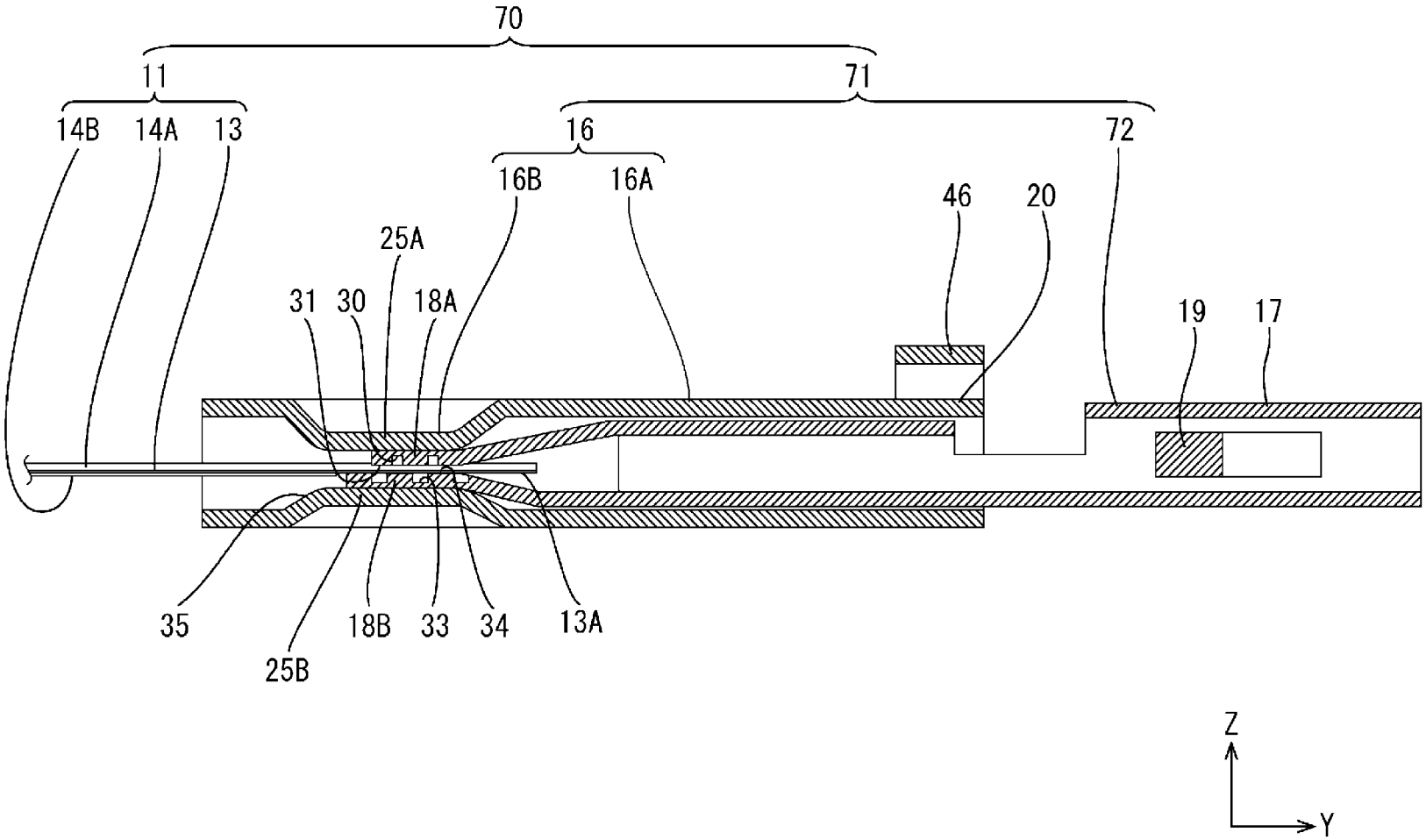
FIG. 8 is a section showing a flexible board with terminal according to the third embodiment.

Next, a third embodiment of the present disclosure is described with reference to FIGS. 7 and 8. As shown in FIG. 7, in a flexible board with terminal 70 according to this embodiment, an upper sandwiching portion 18A is provided with no upper spring portion and a lower sandwiching portion 18B is provided with no lower spring portion, out of a terminal body 72 of a terminal 71.

Since the other components are substantially the same as in the first embodiment, the same members are denoted by the same reference signs and repeated description is omitted.

According to this embodiment, since the terminal body 72 is provided with neither the upper spring portion nor the lower spring portion, the manufacturing cost of the terminal 71 can be reduced.

Since the terminal 71 and a flexible board 11 can be electrically connected by arranging a narrow portion 16B of a slide portion 16 outside the upper and lower sandwiching portions 18A, 18B, a large-scale facility such as a welding machine or reflow furnace is unnecessary. Thus, the manufacturing cost can be reduced.

Since the terminal 71 and the flexible board 11 are not soldered, the occurrence of troubles due to soldering such solder cracks can be suppressed. In this way, the electrical connection reliability of the terminal 71 and the flexible board 11 can be improved.

Since the terminal 71 and the flexible board 11 are not soldered, a heating process by a reflow furnace is unnecessary. In this way, a reduction in the spring performance of a resilient contact piece 19 can be suppressed.

Other Embodiments (1) The flexible board is not limited to a flexible printed circuit board and may be a flexible flat board in which a metal foil such as a copper foil is attached to a base film.

(2) A conductive path may be formed on the upper surface of the flexible board or conductive paths may be formed on both upper and lower surfaces of the flexible board.

(3) The terminal body only has to include at least one sandwiching portion or may include three or more sandwiching portions.

(4) The spring portion may be in the form of a leaf spring extending rearward in the extending direction. The spring portion may be supported on both ends.

(5) The terminal may be a male terminal including a male tab.

LIST OF REFERENCE NUMERALS

10, 60, 70; flexible board with terminal
11: flexible board
12, 61, 71: terminal
13: conductive path
13A: land
14A: base film
14B: coverlay
15, 62, 72: terminal body
16: slide portion
16A: wide portion
16B: narrow portion
17: tube portion
18A: upper sandwiching portion
18B: lower sandwiching portion
19: resilient contact piece
20: flexible board connecting portion
25A: upper pressurizing portion
25B: lower pressurizing portion
26: partial lock receiving portion
27: full lock receiving portion
28: locking projection
30: upper serration
31: insulated contact portion
32: upper spring portion
33: lower serration
34: conductive contact portion
35: guide slope
36: upper slit
45: jig
46: jig contact portion
63: lower spring portion
64: lower slit

What is claimed is:

1. A terminal to be connected to a front end part of a flexible board including an insulating base film and a conductive path formed on at least one of front and back surfaces of the base film, the terminal comprising:

a terminal body including a sandwiching portion for sandwiching the flexible board; and a tubular shell to be disposed outside sandwiching portion, wherein:

the sandwiching portion includes a conductive contact portion for contacting the conductive path of the flexible board, the shell includes a pressurizing portion for pressing the sandwiching portion toward the flexible board, the pressurizing portion projecting inwardly of the shell, the shell includes a wide portion not formed with the pressurizing portion and a narrow portion narrower inside than the wide portion by being formed with the pressurizing portion, and the narrow portion is located outside the sandwiching portion, whereby the conductive contact portion of the sandwiching portion contacts the conductive path.

2. The terminal of claim 1, wherein the terminal body includes two sandwiching portions located on sides of the front and back surfaces of the flexible board and the shell includes two pressurizing portions for respectively pressurizing the two sandwiching portions.

3. The terminal of claim 2, wherein one of the two sandwiching portions is provided with the conductive contact portion, and the other of the two sandwiching portions is provided with an insulated contact portion for contacting the base film of the flexible board.

4. The terminal of claim 1, wherein the pressurizing portion is formed with a guide slope inclined inwardly of the shell toward a front side in an extending direction of the conductive path on a rear side in the extending direction.

5. The terminal of claim 1, wherein:

the wide portion is provided on a front side of the shell in an extending direction of the conductive path and the narrow portion is provided on a rear side of the shell in the extending direction, and the shell is slidable between a first state where the wide portion is located outside the sandwiching portion and the pressurizing portion is not in contact with the sandwiching portion and a second state where the narrow portion is located outside the sandwiching portion and the pressurizing portion presses the sandwiching portion toward the flexible board.

6. The terminal of claim 5, wherein both or one of the terminal body and the shell include(s) a partial locking portion for holding the terminal body and the shell in the first state and a full locking portion for holding the terminal body and the shell in the second state.

7. The terminal of claim 1, wherein the sandwiching portion is formed with a resiliently deformable spring portion, and the flexible board is pressed by a resilient force of the spring portion.

8. The terminal of claim 7, wherein the spring portion is in the form of a leaf spring extending forward from a rear side of the sandwiching portion in an extending direction of the conductive path.

9. A flexible board with terminal, comprising:

the terminal of claim 1; and a flexible board to be connected to the terminal.

* * * * *